US010436513B2

(12) United States Patent
Chivers

(10) Patent No.: US 10,436,513 B2
(45) Date of Patent: Oct. 8, 2019

(54) MODULAR OVEN

(71) Applicant: Ronald T. Chivers, Bristow, VA (US)

(72) Inventor: Ronald T. Chivers, Bristow, VA (US)

( * ) Notice: Subject to any disclaimer, the term of this patent is extended or adjusted under 35 U.S.C. 154(b) by 244 days.

(21) Appl. No.: 15/275,249

(22) Filed: Sep. 23, 2016

(65) Prior Publication Data

US 2017/0082366 A1 Mar. 23, 2017

Related U.S. Application Data

(60) Provisional application No. 62/222,728, filed on Sep. 23, 2015.

(51) Int. Cl.

| | |
|---|---|
| ***F27D 11/02*** | (2006.01) |
| ***F27D 1/18*** | (2006.01) |
| ***F27D 5/00*** | (2006.01) |
| ***F27D 19/00*** | (2006.01) |

(52) U.S. Cl.

CPC ..... *F27D 11/02* (2013.01); *F27D 1/1858* (2013.01); *F27D 5/00* (2013.01); *F27D 19/00* (2013.01)

(58) Field of Classification Search

CPC ..... F24D 11/02; F27D 1/1858; F27D 5/00; F27D 19/00; F24C 3/14; F24C 3/124; F24C 1/16

See application file for complete search history.

(56) References Cited

U.S. PATENT DOCUMENTS

| | | | | |
|---|---|---|---|---|
| 3,155,814 A | | 11/1964 | Appleman et al. | |
| 3,395,267 A | * | 7/1968 | MacKay | A47J 39/006 219/387 |
| 3,412,234 A | | 11/1968 | Otavka | |
| 3,428,039 A | | 2/1969 | Desmoulins | |
| 3,979,575 A | * | 9/1976 | Maahs | F27D 11/02 219/407 |
| 5,921,229 A | * | 7/1999 | Blake | F24C 3/14 126/275 R |
| 7,208,700 B2 | | 4/2007 | Peterson et al. | |

FOREIGN PATENT DOCUMENTS

| | | |
|---|---|---|
| CA | 2075669 A1 | 2/1993 |

* cited by examiner

*Primary Examiner* — Shawntina T Fuqua
(74) *Attorney, Agent, or Firm* — Richard C. Litman

(57) ABSTRACT

A modular oven includes a plurality of interlockable insulated panels for user assembly into a cubic structure of an oven. The panels include a top panel, a bottom panel, a left panel, a right panel, a back panel, and a front panel. The front panel can be pivotally mounted to the left or right panel and serves as a door for the modular oven. The top panel and the bottom panel are selectively coupled to the left, back, and right panels by mounting pegs. The bottom panel is provided with a heating element on one side and a plurality of casters on the other side to facilitate transporting the oven. A control module is selectively coupled to one of the panels to control operations of the oven. The oven may also be provided with a trolley system to facilitate transport of workpieces to and from the oven.

20 Claims, 10 Drawing Sheets

MODULAR OVEN

CROSS-REFERENCE TO RELATED APPLICATION

This application claims the benefit of U.S. Provisional Patent Application Ser. No. 62/222,728, filed Sep. 23, 2015.

1. FIELD OF THE INVENTION

The present invention relates to appliances, and particularly to a modular oven for the home workshop that can be easily assembled, dismantled, and reconfigured for various user needs.

2. DESCRIPTION OF THE RELATED ART

Many heavy-duty type of projects require specialized tools or equipment. One of these types of projects requires heat curing, such as powder coating various mechanical or aesthetic components. Unfortunately, a typical person does not have ready access to such equipment without substantial financial investment or utilizing/renting the necessary equipment from a facility. An owner of such equipment must also contend with storage space and power requirements. Moreover, such equipment is typically too bulky and heavy to be easily moved. Such drying ovens are usually stationary and occupy considerable storage space in the workshop.

There is a need for some sort of economical heat curing device that can be easily transported, occupies minimal space, and utilizes a power source available in a typical household. Thus, a modular oven solving the aforementioned problems is desired.

SUMMARY OF THE INVENTION

The modular oven has a plurality of panels that a user may assemble into a cubic oven housing. The panels include a top panel, a bottom panel, a left panel, a right panel, a back panel, and a front panel. The front panel is pivotally mounted to either the left or right panel and serves as a door for the modular oven. The top panel and the bottom panel are selectively coupled to the left, back, and right panels by mounting pegs. The bottom panel includes a heating element on one side and a plurality of casters at the other side to facilitate mobile placement of the oven. A control module is selectively coupled to one of the panels to control operations of the oven. The oven may also be provided with a trolley system to facilitate transport of workpieces to and from the oven.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
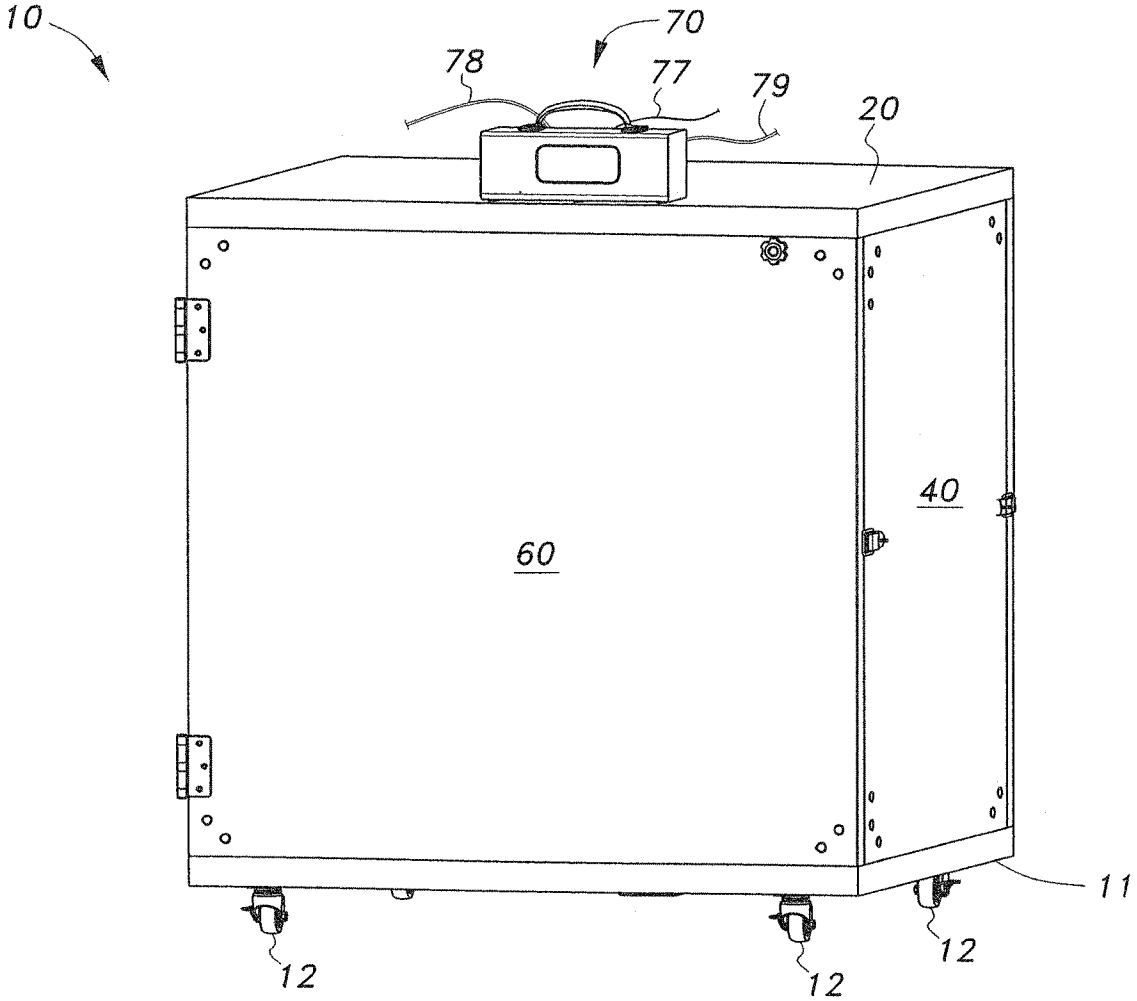
FIG. 1 is a perspective view of a modular oven according to the present invention, shown with the door closed.
Figure 2:
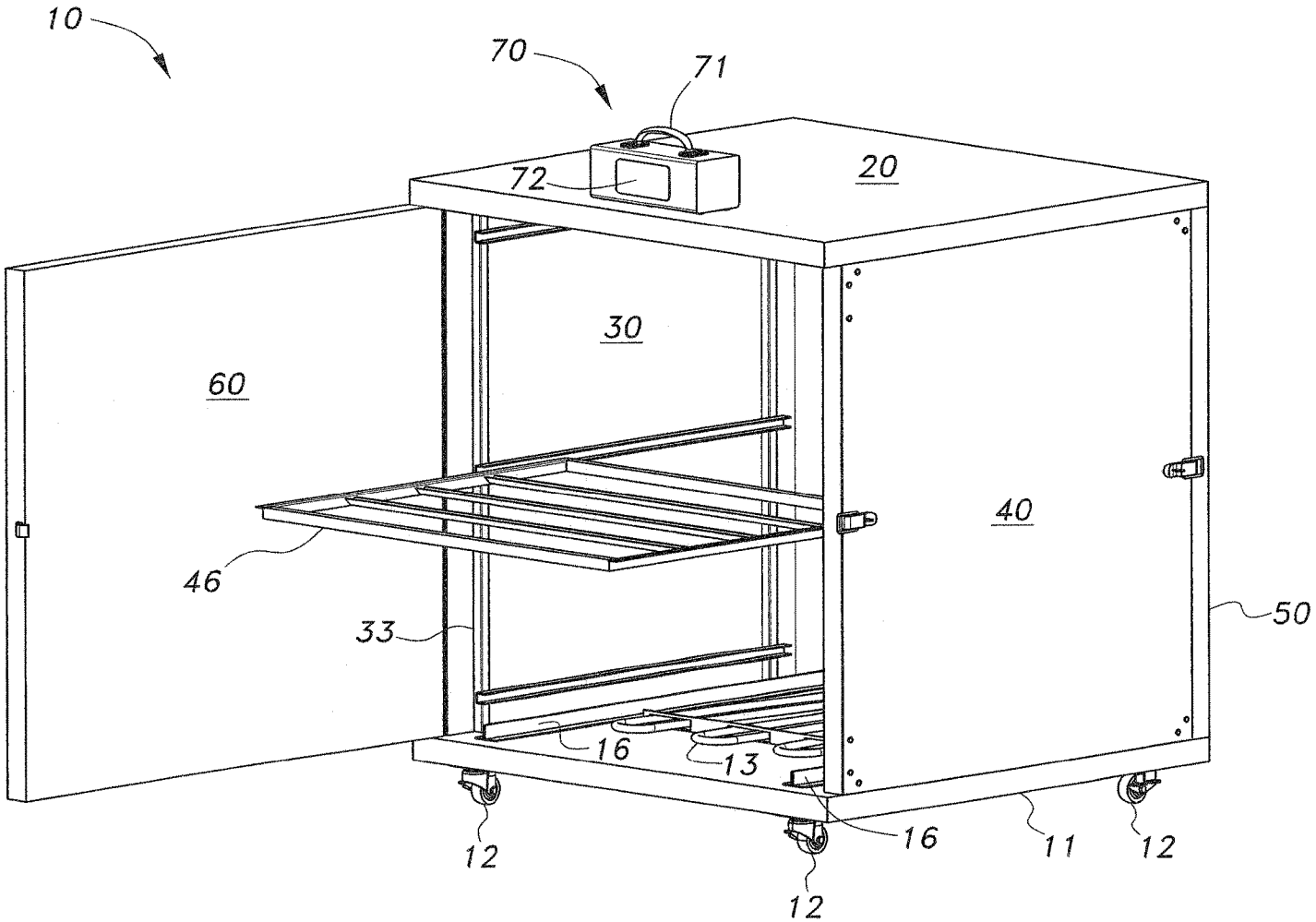
FIG. 2 is another perspective view of the modular oven of FIG. 1, shown with the door open.

The modular oven 10 provides a portable and reconfigurable heat curing system for a workshop that may be easily assembled and dismantled for storage. It is to be understood, however, that while the modular oven 10 is described for use as a heat curing device, the modular oven 10 can also be used as a conventional oven for foodstuffs. As best seen in FIGS. 1-4, the modular oven 10 generally includes a plurality of separate panels that can be easily assembled to form a box-shaped oven having an attached control module 70 to control operations of the modular oven 10.

The modular oven 10 includes a bottom or lower panel 11, a top or upper panel 20, a front panel 60, a back panel 50, a first or left side panel 30, and a right or second side panel 40. These separable panels 11, 20, 30, 40, 50, 60 permit the modular oven 10 to be easily assembled for use and dismantled for storage. When disassembled, the separate panels 11, 20, 30, 40, 50, 60 may be stacked on top of each other or placed on edge next to each other, which occupies minimal storage space. Moreover, each panel 11, 20, 30, 40, 50, 60 is constructed so that they may be easily assembled for use. The overall shape of the modular oven 10 forms a generally square cube, and each panel 11, 20, 30, 40, 50, 60 is preferably constructed to form a generally uninterrupted side of the cube when assembled. As a result, one or more of the panels 11, 20, 30, 40, 50, 60 may be shorter in length and/or height. Though not shown, each panel 11, 20, 30, 40, 50, 60 is generally constructed as a metal frame having sheet metal covering the frame. Insulation fills spaces or voids within the frame to provide thermal insulation, protecting the user from potential burns during use, as well as maintaining desired temperatures within the modular oven 10. All of the panels 11, 20, 30, 40, 50, 60 are preferably uniform, having the same thickness for ease of construction.

Figure 3:
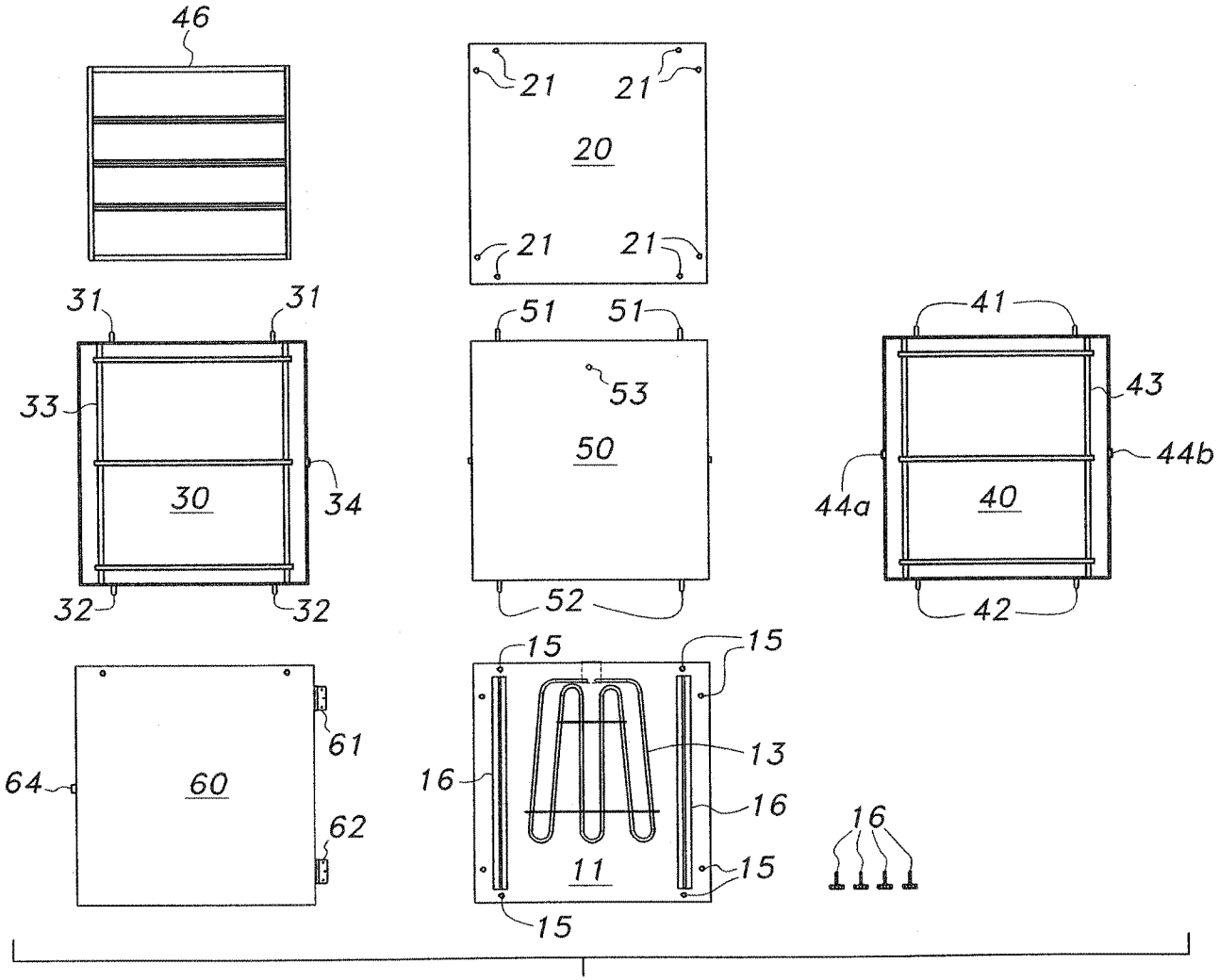
FIG. 3 is a plan view of the housing components of the modular oven of FIG. 1, shown disassembled and showing the inner face of the panels.
Figure 4:
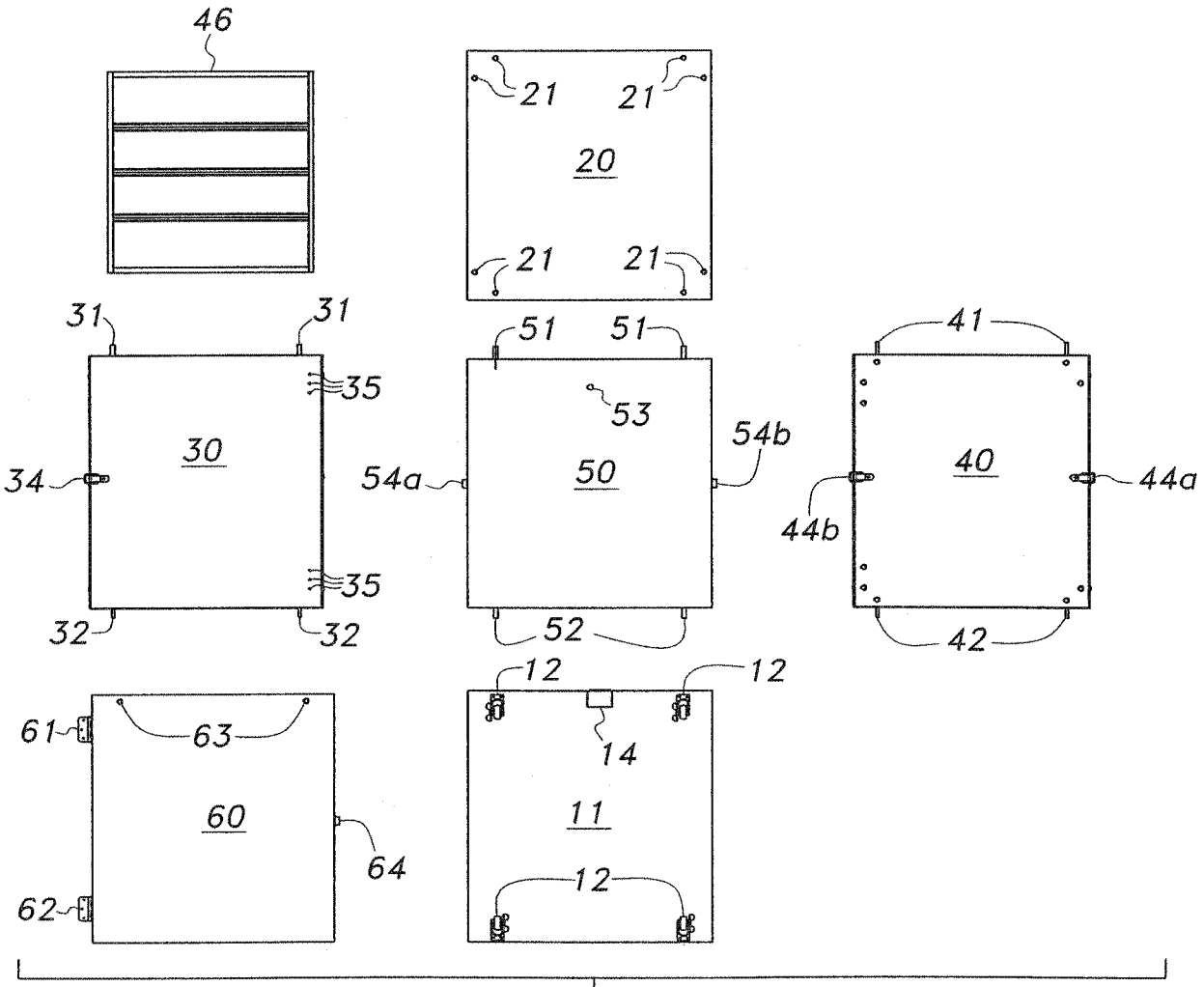
FIG. 4 is a plan view of the housing components of the modular oven of FIG. 1, shown disassembled and showing the outer face of the panels.

Referring to FIGS. 3 and 4, which shows the inner and outer faces of the panels 11, 20, 30, 40, 50, 60, respectively, the bottom panel 11 forms the base of the modular oven 10. The bottom panel 11 is supported on casters 12 to provide easy mobility to the assembled modular oven 10. This allows the user to easily transport and position the modular oven 10 to a desired location. On the inner face, the bottom panel 11 includes a heating element 13 extending from the rear of the bottom panel 11 towards the front of the bottom panel 11. A power input socket 14 (shown in FIG. 4) extends from the rear portion of the bottom panel 11 for connection to a power supply. At least three sides of the bottom panel 11 are provided with a pair of mounting holes 15. Each pair of mounting holes 15 permits insertion of pegs or dowels 32, 42, 52 extending from the bottom edge of the rear panel 50 or side panel 30, 40 therein. The top side or inner face of the bottom panel 11 may also include a pair of spaced trolley rails 16 to support a trolley 90 of a trolley system 80 thereon.

The top panel 20 preferably has the same dimensions as the bottom panel 11 so that both the bottom panel 11 and the top panel 20 define the upper and lower planar sides of the general cubic shape of the modular oven 10. The top panel 20 is provided with respective pairs of mounting holes 21 to permit insertion of mounting pegs or dowels 31, 41, 51 extending from the top edge of the rear panel 50 and side panels 30, 40 therein.

The left panel 30 is a generally square panel provided with a pair of spaced upper mounting pegs 31 and lower mounting pegs 32 extending from the top edge and bottom edge of the left panel 30, respectively. The upper mounting pegs 31 and lower mounting pegs 32 may be threaded into the respective upper edge and lower edge of the left panel 30 or mounted thereon by other means, such as press-fit coupling and the like. The upper mounting pegs 31 slidably mount into corresponding mounting holes 21 on the inner face of the top panel 20, while the lower mounting pegs 32 slidably mount into corresponding mounting holes 15 on the inner face of the bottom panel 11.

The inner face of the left panel 30 is also provided with a first or left rack frame assembly 33 mounted thereon. The left rack frame assembly 33 forms part of a full rack frame for selective mounting of one or more racks 46 thereon. To assist in stabilizing the left panel 30, the left panel 30 may be provided with one or more latch mechanisms, or at least a first part 34 of a latch mechanism, to connect one side edge of the left panel 30 to an adjacent side edge of the back panel 50. The outer face of the left panel 30 also includes a plurality of spaced hinge mounting holes 35.

Figure 5:
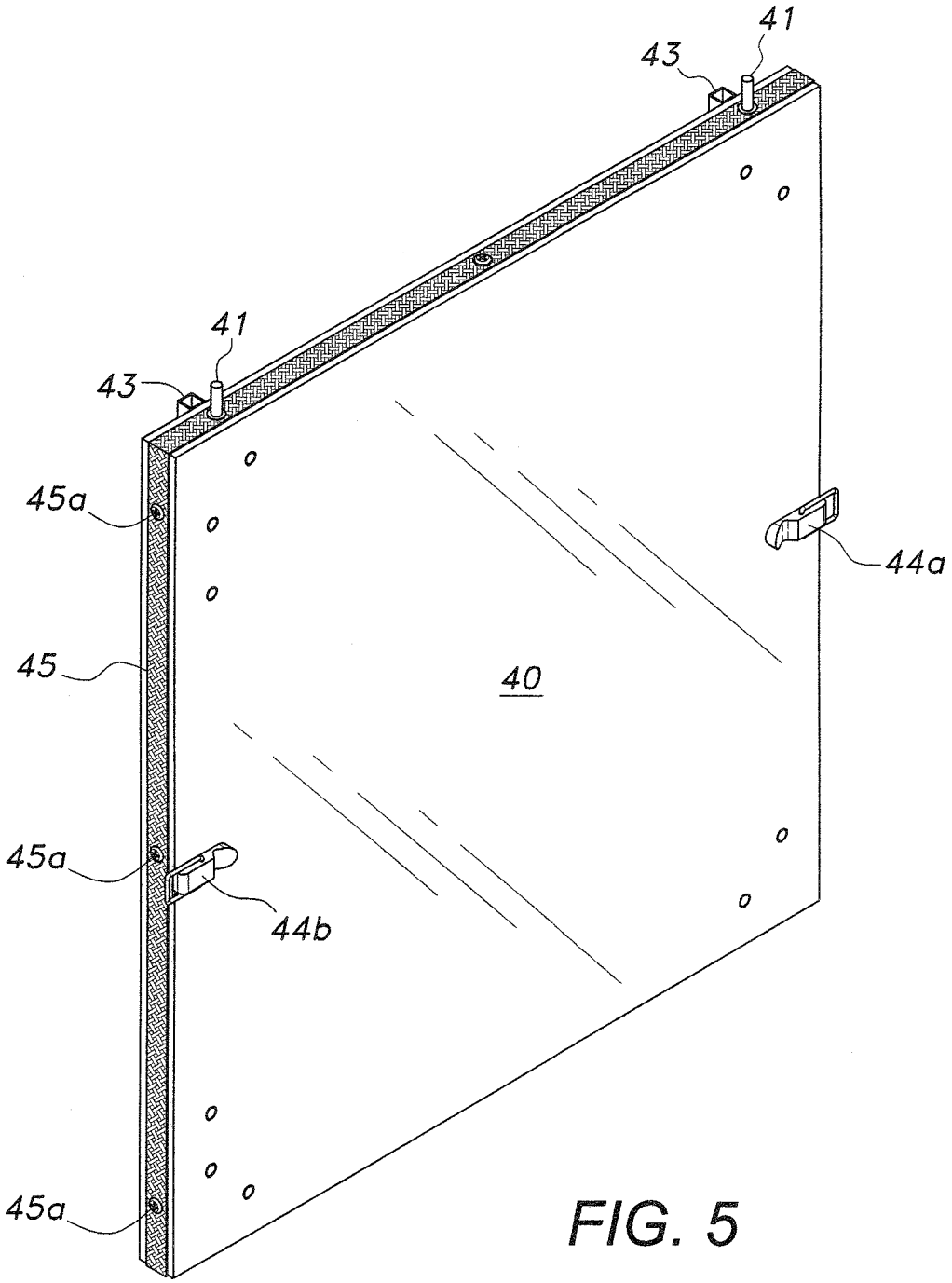
FIG. 5 is a perspective of one of the side panels of the modular oven of FIG. 1.

The right panel 40 is a generally square panel provided with a pair of spaced upper mounting pegs 41 and lower mounting pegs 42 extending from the top edge and bottom edge of the right panel 40, respectively. The upper mounting pegs 41 and lower mounting pegs 42 may be threaded into the respective upper edge and lower edge of the right panel 40 or mounted thereon by other means, such as press-fit coupling and the like. The inner face of the right panel 40 is also provided with a second or right rack frame assembly 43 mounted thereon. The right rack frame assembly 43 forms the remainder of a full rack frame for selective mounting of the rack 46 thereon. To assist in stabilizing the right panel 40, the right panel 40 may be provided with one or more latch mechanisms, or at least a first part 44*a* of a latch mechanism, to connect one side edge of the right panel 40 to an adjacent side edge of the back panel 50. In FIG. 4, the right panel 40 is provided with a pair of spaced first parts 44*a*, 44*b* of a pair of latch mechanisms disposed on opposite sides of the outer face of the right panel 40. Both the left panel 30 and the right panel 40 are preferably identical in dimensions. When assembled, the upper mounting pegs 41 slidably mount into corresponding mounting holes 21 on the inner face of the top panel 20, while the lower mounting pegs 42 slidably mount into corresponding mounting holes 15 on the inner face of the bottom panel 11. As best seen in FIG. 5, the peripheral edge of the right panel 40 may include a sealing strip 45 to assist sealing the interior of the modular oven 10 when assembled and maximize heat retention therein during use. Thus, the sealing strip 45 is preferably constructed from thermal insulated material. The sealing strip 45 may be mounted to the edge of the right panel 40 with fasteners 45*a*, adhesives, and the like. Preferably, at least the left panel 30 and the right panel 40 are provided with a corresponding sealing strip.

The back panel 50 is also a generally square panel provided with a pair of spaced upper mounting pegs 51 and lower mounting pegs 52 extending from the top edge and bottom edge of the back panel 50. The upper mounting pegs 51 and lower mounting pegs 52 may be threaded into the respective upper edge and lower edge of the back panel 50 or mounted thereon by other means, such as press-fit coupling and the like. The upper mounting pegs 51 slidably mount into corresponding mounting holes 21 on the inner face of the top panel 20, while the lower mounting pegs 52 slidably mount into corresponding mounting holes 15 on the inner face of the bottom panel 11. The back panel 50 also includes a sensor hole 53 for selective mounting of a thermocouple 77*b*. Additionally, second parts 54*a*, 54*b* of the latch mechanisms are provided on opposite sides of the back panel 50. The second part 54*b* works in conjunction with the first part 44*a* to latch the back panel 50 to the right panel 40. The second part 54*a* works in conjunction with the first part 34 on the left panel 30 to latch the back panel 50 to the left panel 30. These first and second parts 34, 44*a*, 44*b*, 54*a*, 54*b* may be a hook and corresponding eyelet, or other fastening means that can easily be secured without the use of tools.

The front panel 60 serves as a door for the modular oven. The front panel 60 is also a generally square panel provided with a pair of spaced upper hinge leaf 61 and lower hinge leaf 62. A leaf of each upper hinge 61 and lower hinge 62 pivotally mounts the front panel 60 to the left panel 30 via thumbscrews 16. The other leaf of each of the upper hinge 61 and lower hinge 62 is mounted to the left side of the front panel 60. Either lateral side of the front panel 60, as well as the top or bottom, can be used to mount the hinges 61, 62. It is preferable to leave the upper hinge 61 and the lower hinge 62 pre-mounted or pre-installed to the desired side of the front panel 60 so that only one leaf needs to be selectively mounted to the left panel 30. Additionally, thumbscrews 16 and the like are preferred type of fasteners to facilitate a substantially tool-less assembly of the modular oven 10. The front panel 60 can also be provided with one or more mounting holes 63 near the corners at the top and/or bottom to mount an additional thumbscrew 16. At least this thumbscrew 16 (to be mounted near the desired corner) preferably has a relatively large head to serve as a handle for selectively opening and closing the front panel 60 when assembled. The upper hinge 61 and the lower hinge 62 permit the front panel 60 to swivel 270° so that the front panel 60 may rest against the left panel 30 in a fully open position.

The control module 70 is preferably constructed to be a detachable component that may be placed at any desired location on any of the panels 11, 20, 30, 40, 50, 60. In most instances, the control module 70 is normally placed on the exterior of the top panel 20 for convenient access. The control module 70 is a generally rectangular box provided with a handle 71 at the top and a control panel 72 at the front face. The control panel 72 permits the user to selectively provide power to the modular oven 10, set or input operational parameters (such as temperature and timers), and can include other functions, such as a clock and preheat operations.

Figure 6:
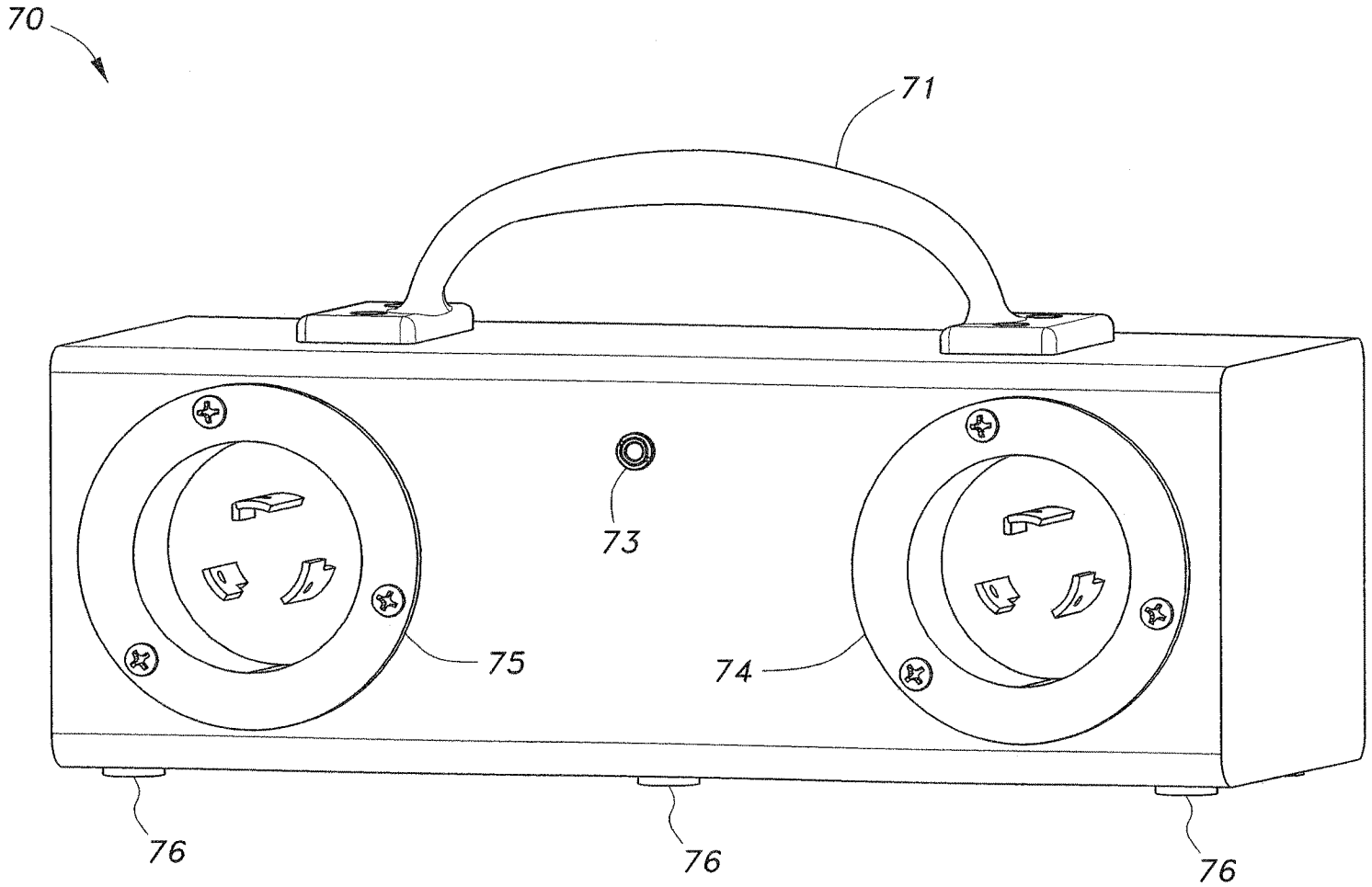
FIG. 6 is a perspective view of a control module of the modular oven of FIG. 1 as seen from the rear of the module.
Figure 7:
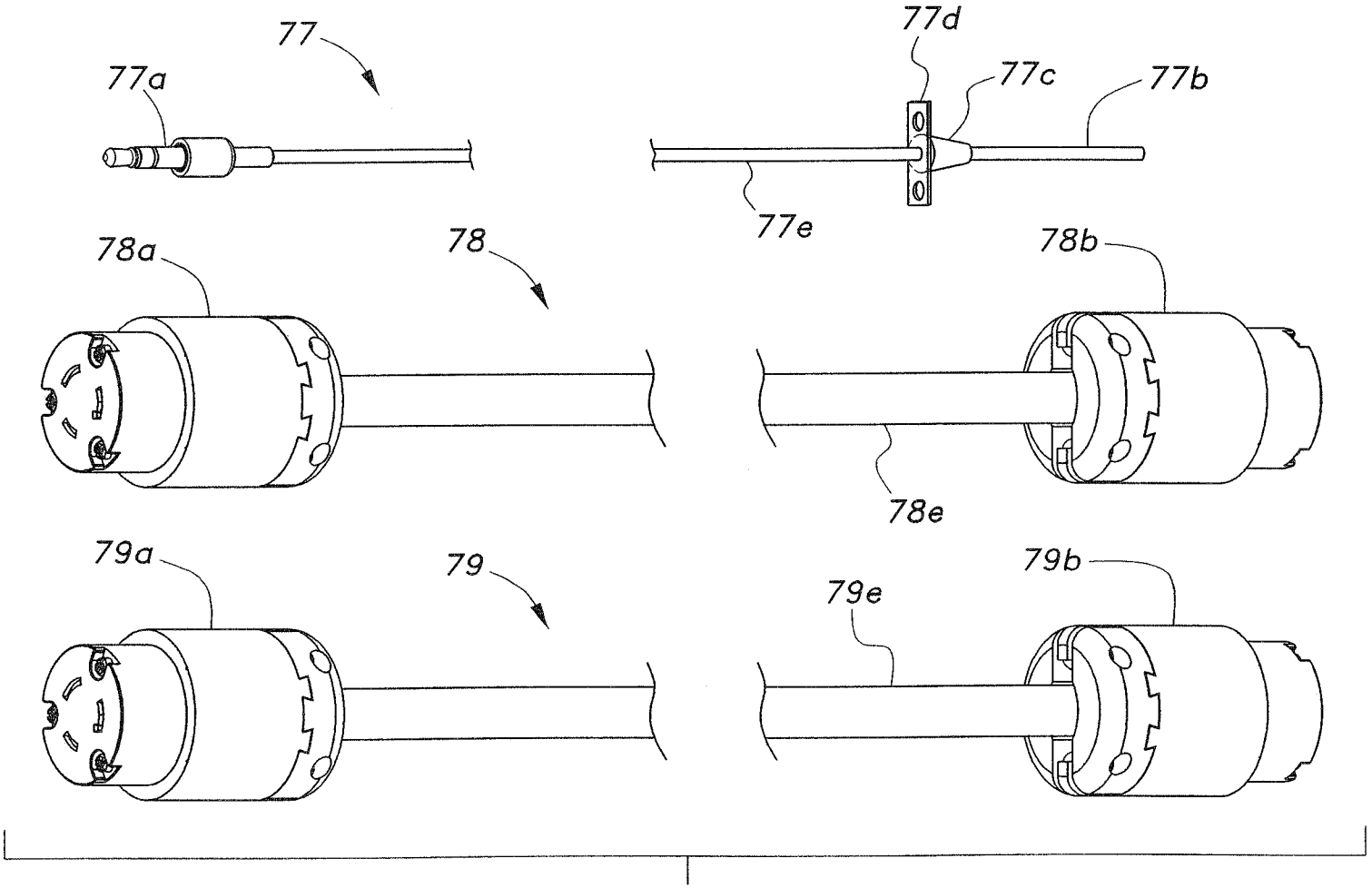
FIG. 7 is a perspective view of various electrical cords of the modular oven of FIG. 1.

As best seen in FIGS. 6 and 7, the back of the control module 70 is provided with various ports, connectors, or sockets to facilitate power delivery and operations of the modular oven 10. The control module 70 may include a temperature monitor port 73, a power input port or socket 74, and a power output port or socket 75. To facilitate detachable mounting of the control module 70, the control module 70 may be provided with one or more magnetic feet 76 to allow the user to place the control module 70 at any desired location on the top panel 20 or any of the other panels 30, 40, 50, 60. The bottom panel 11 may not be a desirable base for placement of the control module 70, since it may cause some difficulty in accessing the control functions.

The temperature monitor port 73 allows for detachable coupling of an elongate temperature monitor line 77. The temperature monitor line 77 is preferably an elongate wire cable 77*e* having a male connector 77*a* at one end and the thermocouple or temperature sensor 77*b* at the opposite end. The connector 77*a* may be coupled to the temperature monitor port 73, while the thermocouple 77*b* is inserted through the sensor hole 53 on the back panel 50. The thermocouple 77*b* extends into the interior of the modular oven 10, and is used to set and monitor operating temperatures of the modular oven 10. Although the size of the sensor hole 53 may have a tight tolerance to maintain the inserted position of the thermocouple 77*b* and prevent heat leakage, the temperature monitor line 77 preferably includes a frustoconical plug 77*c* in line with the thermocouple 77*b* to block the sensor hole 53 when the thermocouple 77*b* has been inserted therethrough. The frustoconical plug 77*c* is preferably made from a deformable material providing thermal insulation, such as silicone and the like. To stabilize the mounting of the thermocouple 77*b*, the temperature monitor line 77 may also be provided with an elongate brace plate 77*d* in line and next to the frustoconical plug 77*c*, the brace plate 77*d* abutting against the outer surface of the back panel 50 when the frustoconical plug 77*c* has been seated through the sensor hole 53 to keep the thermocouple 77*b* in a generally perpendicular position with respect to the vertical orientation of the back panel 50 when assembled.

The power input port 74 allows for detachable coupling of an elongate power input line 78. The power input line 78 is preferably constructed as an elongate wire cable 78*e* having a first connector 78*a* at one end and a second connector 78*b* at the opposite end. One of the first connector 78*a* or the second connector 78*b* couples to the power input port 74 while the other connector connects to a conventional power supply in a household or other residence. The power requirements for the modular oven 10 may require connection to a 240-volt electrical outlet, such as those used for washing machines, dryers, kitchen ranges, and the like, and the first connector 78*a* and the second connector 78*b* are preferably constructed for those types of outlets. Moreover, each connector 78*a*, 78*b* is preferably provided with a twist lock mechanism for securing the connection.

The power output port 75 allows for detachable coupling of an elongate power output line 79. The power output line 79 is preferably constructed as an elongate wire 79*e* having a first connector 79*a* at one end and a second connector 79*b* at the opposite end. One of the first connector 79*a* or the second connector 79*b* couples to the power output port 75, while the other connector connects to the power input socket 14 at the bottom of the bottom panel 11. As with the power input line 78, the connectors 79*a*, 79*b* are preferably provided with a twist lock mechanism for securing the connection. In use with the temperature monitor line 77, power input line 78, and the power output line 79 properly connected to the control module 70, the control module 70 selectively outputs power to the heating element 13 by relaying power from the power input line 78 to the power output line 79 in accordance with the operational parameters input through the control panel 72. When heating is not required, power to the power output line 79 is shut off, although the power input line 78 remains connected. The power from the power input line 78 provides the necessary power for operation of the control module 70 when not transferring the same to the power output line 79.

Figure 8:
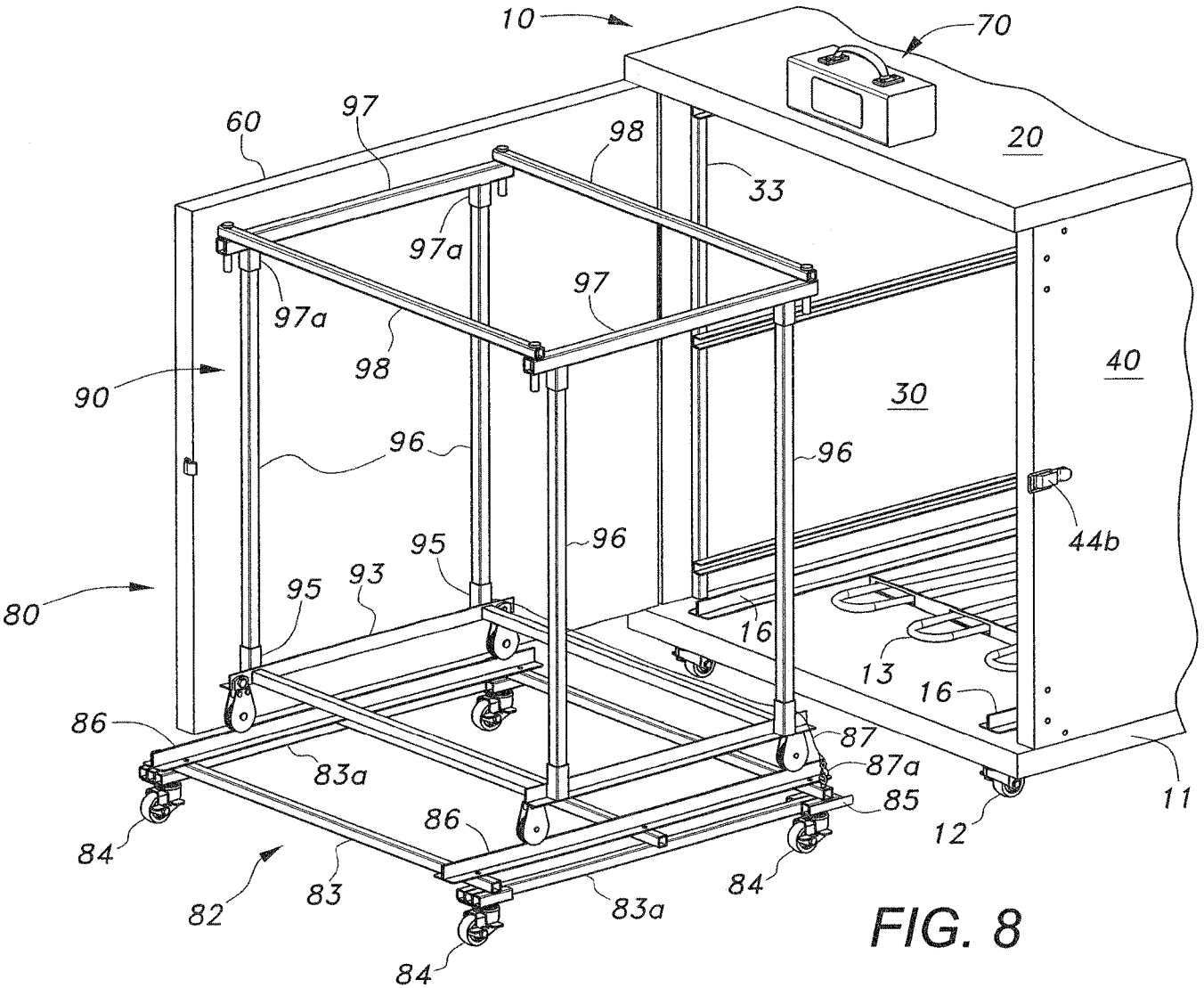
FIG. 8 is a partial perspective view of the modular oven of FIG. 1, showing a trolley ready for insertion into the modular oven.
Figure 9:
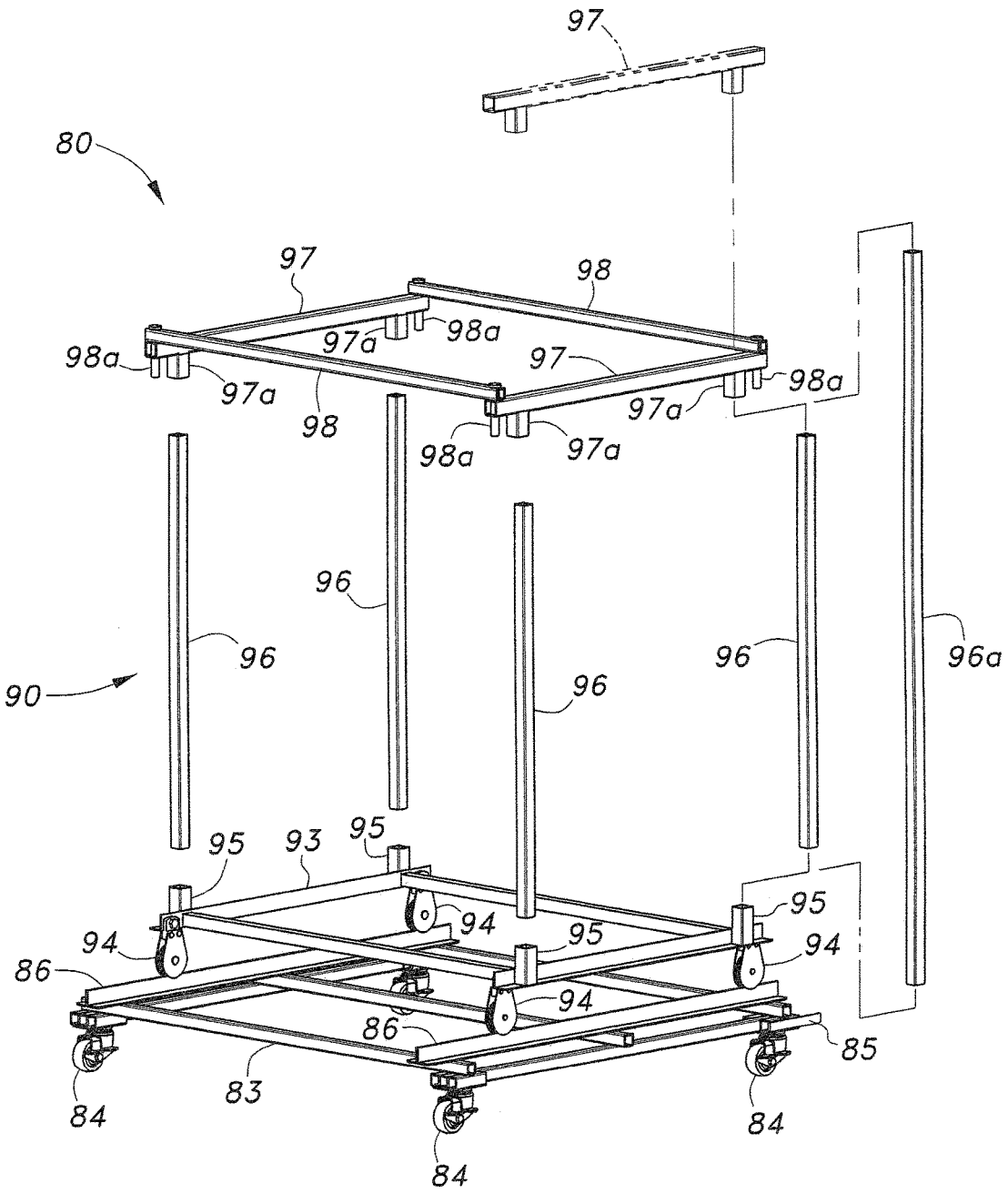
FIG. 9 is a partial exploded perspective view of the trolley system shown in FIG. 8.

As shown in FIGS. 8 and 9, the modular oven 10 may also be provided with a trolley system 80 for transporting heavy workpieces into and out of the modular oven 10. The trolley system 80 includes a base carrier 82 and a trolley 90 configured to be rolled onto the base carrier 82 and transported thereby.

The base carrier 82 is preferably a generally square frame 83 having a plurality of casters 84 mounted to the corners thereof. Each of these casters 84 may be provided with a locking mechanism to lock the wheel of the caster 84 to securely park the base carrier 82 at a desired location. Each of the elongate, spaced side frame members 83*a* has a guide tab or finger 85 projecting collinearly past the respective caster 84. The guide tabs 85 are spaced about the same width as the bottom panel 11, and they serve to align the base carrier 82 with the bottom panel 11 as the base carrier 82 is moved into position by straddling the sides of the base panel 11, so that the base carrier 82 abuts against an edge of the base panel 11. The base carrier 82 also includes a pair of spaced rails 86 mounted on top of the frame 83. The rails 86 allow the trolley 90 to move on the base carrier 82. When the base carrier 82 abuts against the edge of the base panel 11, the rails 86 align with the rails 16 on the base panel 11 to form a relatively long rail for the trolley 90 to travel between the base carrier 82 and the base panel 11 into the oven 10.

The trolley 90 is an easily reconfigurable unit that may be easily assembled and dismantled to form a transportable framework, from which one or more workpieces can hang or be attached to for subsequent curing within the modular oven 10. The trolley 90 includes a generally square base frame 93 having a plurality of casters 94 mounted to the corners thereof. Each caster 94 is preferably provided with a grooved wheel that rides along the corresponding rail 86 on the base carrier 82. A vertically oriented mounting bar or socket 95 extends upward from each corner of the base frame 93. These mounting sockets 95 can also be referred to as lower mounting sockets 95. One end of a plurality of vertical frame members 96 are each insertably mounted to a respective lower mounting socket 95 to define the corners as well as the height of the overall box-shaped frame of the trolley 90. As best seen in FIG. 9, the trolley 90 may be provided with different heights (or lengths) of the vertical frame members 96, such as the vertical frame members 96*a*, which are taller than the vertical frame members 96. The vertical frame members 96 are of a height so that the assembled trolley 90 will fit inside the modular oven 10. The taller vertical frame members 96*a* can be used in place of the vertical frame members 96 to extend the height of the trolley 90 and accommodate taller or longer workpieces to be cured. The vertical members 96, 96*a* can also be referred to as first vertical members 96 and second vertical members 96*a*, respectively.

Once assembled, a pair of elongate first cross members 97 connect a pair of respective vertical members 96 or vertical members 96*a* at the top of the overall trolley frame. Each of the first cross members 97 is provided with a pair of spaced, downwardly extending mounting bars or sockets 97*a*, similar to the lower mounting sockets 95. The mounting sockets 97*a* can also be referred to as upper mounting sockets 97*a*. The upper mounting sockets 97*a* secure the upper or top end of the vertical frame members 96 or 96*a*. The lower mounting sockets 95, the vertical members 96 or 96*a*, the first cross members 97, and the upper mounting sockets 97*a* are preferably made from square, steel tubing safe for withstanding the heat from heat curing and providing relative ease in assembling a secure frame.

The trolley 90 may also include a pair of elongate second cross members 98 connecting the first cross members 97 to each other. Thus, each second cross member 98 is oriented normal to the first cross members 97. The second cross members 98 are preferably similar to the first cross members 97 in terms of material and shape of the bars used in the construction thereof. To secure the second cross members 98 to the first cross members 97, a locking pin 98*a* is inserted through a bore at each end of the second cross members 98 and through a corresponding bore at the end of the first cross members 97. Each locking pin 98*a* is preferably an elongate, smooth or non-threaded pin having a head at one end similar to a nail. The head prevents the locking pin 98*a* from falling through the respective holes. The tolerance between the locking pin 98*a* and the ends of the first cross member 97 and the second cross member 98 may be close or loose, since the connection between the second cross members 98 and the first cross members 97 via the locking pins 98*a* is generally sufficient to reinforce the overall frame. Moreover, a smooth locking pin 98*a* allows for quick and easy securing of the cross members 97, 98.

The trolley system 80 may include a securing means, such as a securing line 87, to secure the trolley 90 onto the base carrier 82 during transport. If left unsecured, the trolley 90 can be subjected to sliding along the rails 86, which may potentially dislodge the trolley 90 during transport, especially to and from the modular oven 10. The securing line 87 includes a pair of hooks 87*a* to facilitate securing the base frame 93 to the base carrier 82. Other types of securing means include, but are not limited thereto, integrated and non-integrated clamps, latches, and the like.

In use, the base frame 93 of the trolley 90 may be stacked on top of the base carrier 82, and the remainder of the box-shaped frame can be assembled in-situ thereon. Alternatively, the trolley 90 may be assembled remote from the base carrier 82 and rolled onto the same after assembly. The trolley 90 is then secured to the base carrier 82 by the securing line 87. A workpiece, such as a powder-coated wheel, may be suspended within the frame of the trolley 90, and the trolley system 80 may then be transported to the front of the open modular oven 10 where the guide fingers 85 straddle the side edges of the bottom panel 11 to insure alignment between the rails 86 and the trolley rails 16. The securing line 87 is then removed, and the trolley 90 is free to roll from the base carrier 82 into the interior of the modular oven 10. The base carrier 82 is removed from engagement with the modular oven 10 to enable closure of the front panel 60. The user sets the temperature and time on the control module 70 for the curing process to be performed on the powder-coated wheel. Once this process is completed, the base carrier 82 is moved back into position after opening the front panel 60. The trolley 90 with the workpiece suspended thereon is rolled onto the base carrier 82 for subsequent cooling and processing. When not in use, the modular oven 10 and the trolley system 80 can be dismantled relatively quickly and easily due to the tool-less configuration for subsequent storage.

Figure 10:
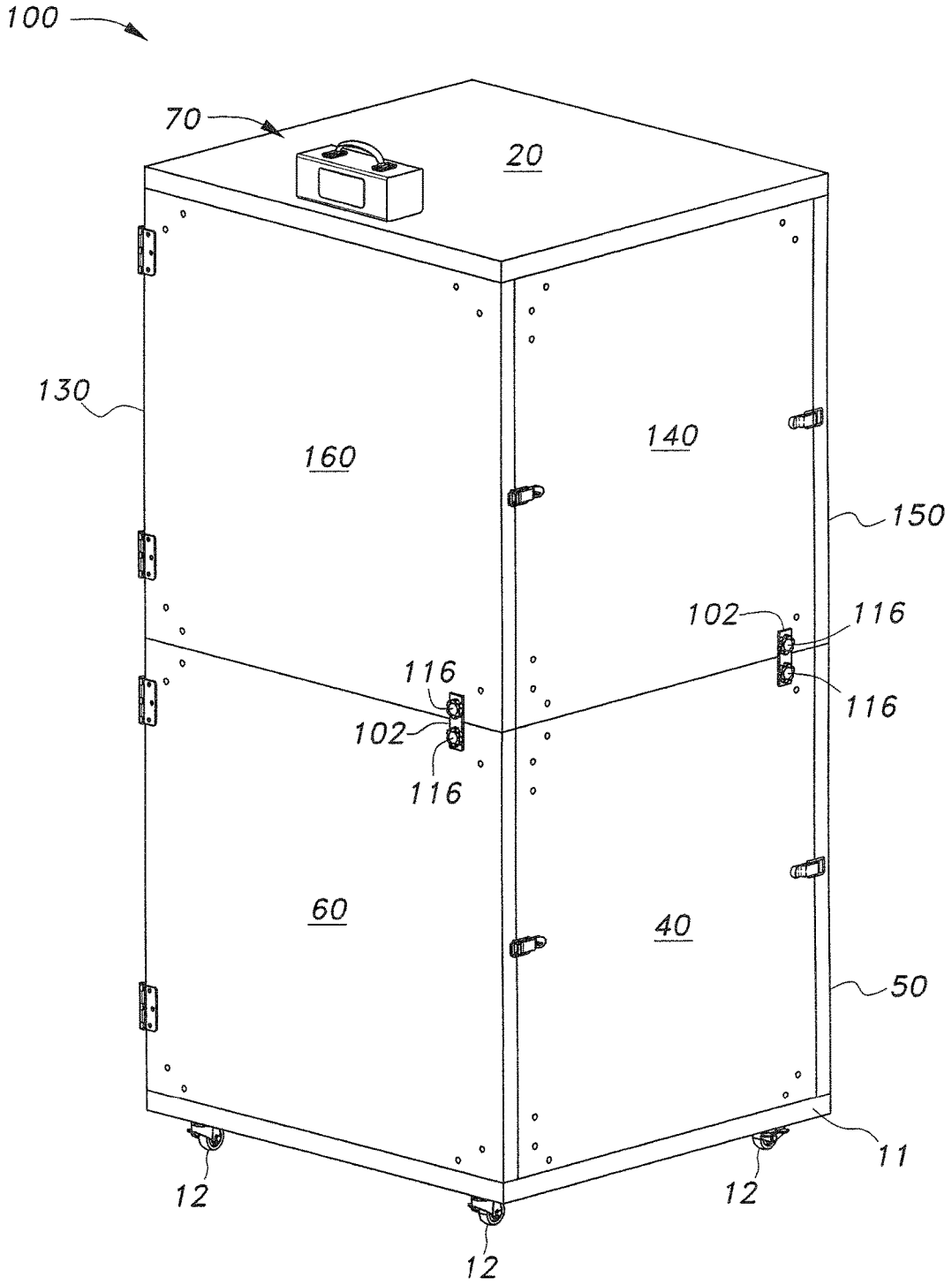
FIG. 10 is a perspective view of a modular oven according to the present invention having two cubic oven housings stacked together.

Another embodiment or configuration of the modular oven 100 is shown in FIG. 10. In this embodiment, the modular oven 10 has been reconfigured into a taller oven for curing larger workpieces. The modular oven 100 has been provided with an additional left panel 130, back panel 150, right panel 140, and a front panel 160 stacked on top of the corresponding panel in the smaller, modular oven 10, which effectively doubles the holding capacity inside the modular oven 100 compared to the modular oven 10. The stacked panels are secured to each other by corresponding mounting pegs and one or more brackets 102 spanning the stacked panels, e.g., front panels 60, 160, right panels 40, 140, and back panels 50, 150. Thumbscrews 116 securely fasten the stacked panels to each other via the bracket 102. As noted above, the trolley 90 can be assembled with the second vertical members 96*a*, and the resultant, assembled trolley 90 will fit inside the taller modular oven 100.

Thus, it can be seen that the modular oven 10, 100 is a portable, relatively easy to assemble and dismantle system for heat curing articles or workpieces, as well as for normal baking. It is to be understood that for safety considerations, the modular oven 10, 100 should either be used for cooking/baking or for heat curing, but not both unless the modular oven 10, 100 has been cleaned thoroughly for cooking purposes by removing any potentially harmful chemical residue that may have been left from heat curing. Furthermore, the modular oven 10, 100 and the trolley system 80 occupy relatively small volume of storage or transport space, and both or either can be supplied to the user in kit form for user assembly. For example, all the panels 11, 20, 30, 40, 50, 60; the respective mounting pegs 31, 32, 41, 42, 51, 52; the fasteners 16 (and/or 116); and the control module 70 along with the associated wires 77, 78, 79 can be provided in a single package. The trolley system 80 may also be provided as an integral or separate package with the oven 10.

It is to be understood that the modular oven 10, 100 encompasses a variety of alternatives. For example, all the panels may be constructed from other materials that provide suitable insulation and heat retention.

It is to be understood that the present invention is not limited to the embodiments described above, but encompasses any and all embodiments within the scope of the following claims.

I claim:

1. A modular oven, comprising:

a detachable cubic housing formed from a plurality of insulated panels, the housing defining a heating chamber, each of the panels being detachably connected to at least another one of the panels to form the cubic heating chamber, the plurality of panels including:

an elongate top panel, the top panel has an inner face and an outer face;

an elongate bottom panel spaced from the top panel, the bottom panel having:

an inner face and an outer face;

a heating element mounted on the inner face;

a power connector mounted on the outer face, the power connector being electrically connected to the heating element;

an elongate left side panel extending between the top panel and the bottom panel;

an elongate right side panel extending between the top panel and the bottom panel;

an elongate back panel extending between the top panel, the bottom panel, the left side panel, and the right side panel;

an elongate front panel pivotally mounted to one of the side panels, the front panel defining a door for the modular oven; and a control module detachably mounted to one of the panels, the control module controlling operation of the modular oven, the control module being electrically connected to the power connector on the bottom panel;

at least one mounting hole is formed on an inner face of each top panel and bottom panel;

at least one mounting hole is formed on a top edge and bottom edge each left side panel, right side panel, back panel, and front panel;

at least one upper mounting peg is detachably coupled to the at least one mounting hole on said top edge of at least said left side panel, right side panel, and bottom panel, the at least one upper mounting peg extending from said top edge of the at least said left side panel, right side panel, and bottom panel when assembled; and at least one lower mounting peg detachably coupled to the at least one mounting hole on the bottom edge of at least said left side panel, right side panel, and bottom panel, the at least one lower mounting peg extending from the bottom edge of the at least said left side panel, right side panel, and bottom panel, the at least one upper mounting peg and the at least one lower mounting peg selectively insertable into corresponding the at least one mounting hole on the inner face of the top panel and the bottom panel, respectively, to align and secure the plurality of panels and form the cubic housing.

2. The modular oven according to claim 1, wherein said bottom panel comprises a plurality of casters mounted on said outer face for supporting said oven on wheels.

3. The modular oven according to claim 1, further comprising at least one pair of spaced latch mechanisms to stabilize and secure said back panel to said left side panel and said right side panel.

4. The modular oven according to claim 1 wherein said front panel comprises at least one hinge coupled to a side of said front panel, and at least one fastener to selectively secure said at least one hinge to hinge mounting holes on one of said left side panel and said right side panel.

5. The modular oven according to claim 4, wherein said at least one fastener comprises at least one thumbscrew.

6. The modular oven according to claim 4, further comprising at least one thumbscrew detachably mounted adjacent a corner of said front panel, said at least one thumbscrew defining a handle for selective opening and closing of said front panel.

7. The modular oven according to claim 4, further comprising at least one latch mechanism coupled to the opposite side of said front panel from said at least one hinge, said at least one latch mechanism securing said front panel to said left side panel and said right side panel when in a closed position.

8. The modular oven according to claim 1, further comprising;

a left rack frame assembly mounted to an inner face of said left side panel;

a right rack frame assembly mounted to an inner face of said right side panel, and at least one rack mountable on said left rack frame assembly and said right rack frame assembly, said left rack frame assembly and said right rack frame assembly forming a full rack frame for selective mounting said at least one rack thereon.

9. The modular oven according to claim 1, wherein said control module comprises:

a substantially rectangular box having a front, back, top, bottom, and sides;

a handle coupled to said top of said substantially rectangular box to ease portability and transport;

a control panel at said front of said substantially rectangular box, said control panel having controls for setting and inputting at least temperature, duration of heating, and selective provision of power;

a plurality of connectors disposed on said back of said substantially rectangular box; and a plurality of magnetic feet mounted to said bottom, said magnetic feet facilitating detachable mounting of said control module onto one of said panels.

10. The modular oven according to claim 9, wherein said plurality of connectors comprises:

a power input socket to selectively connect said control module to a source of power by a power input line;

a power output socket to output power from said power input socket to said power connector on said bottom panel by a power output line; and a temperature monitor port for monitoring temperature inside said heating chamber.

11. The modular oven according to claim 10, further comprising:

a sensor hole extending through said back panel; and an elongate temperature monitor line coupled to said temperature monitor port at one end, said temperature monitor line having an elongate temperature sensor at the opposite end, said temperature sensor extending through said sensor hole into said heating chamber.

12. The modular oven according to claim 1, wherein said plurality of insulated panels further comprises:

at least one other elongate left side panel selectively coupled atop said left side panel and extending between said top panel and said bottom panel;

at least one other elongate right side panel selectively coupled atop said right side panel and extending between said top panel and said bottom panel;

at least one other elongate back panel selectively coupled atop said back panel and extending between said top panel, said bottom panel, said at least one other left side panel, and said at least one other right side panel; and at least one other elongate front panel mounted to one of said at least one other side panels; said at least one other left side panel, right side panel, back panel, and front panel forming an expanded heating chamber when assembled.

13. The modular oven according to claim 1, further comprising a trolley system for transporting suspended workpieces into and out of said heating chamber.

14. The modular oven according to claim 13, wherein said trolley system comprises:

a movable base carrier;

a movable trolley selectively secured to said base carrier, said trolley adapted for transport between said base carrier and said heating chamber; and a pair of spaced trolley rails mounted to said bottom panel, said trolley rails supporting said trolley when said trolley is pushed into said heating chamber.

15. The modular oven according to claim 14, wherein said movable base carrier comprises:

a substantially square frame having a pair of spaced side frame members extending between and connecting end frame members;

a plurality of casters mounted to corners of said frame;

a guide tab extending outwardly past a corresponding caster from each side frame member, said guide tabs straddling lateral sides of said bottom panel to align said base carrier to said trolley rails therein when said base carrier abuts said bottom panel;

a pair of spaced rails mounted on top of said frame, said rails supporting said trolley for transport to said trolley rails on said bottom panel, said rails aligned with said trolley rails on said bottom panel to form continuous rails for transport of said trolley from said base carrier to said bottom panel; and a securing means disposed on said frame to secure said trolley onto said base carrier during transport.

16. The modular oven according to claim 14, wherein said movable trolley comprises:

a substantially square base frame;

a plurality of casters mounted to corners of said base frame;

a vertical, lower mounting socket extending upwardly from each corner of said base frame;

a plurality of elongate vertical frame members each having one end coupled to one of said lower mounting sockets, said plurality of vertical frame members having a given length to define a relative height of said trolley for fitment into said heating chamber;

a pair of elongate first cross members each having a pair of spaced, downwardly extending, vertical upper mounting sockets to secure the opposite end of a pair of vertical frame members, and a locking bore formed on each end of each first cross member;

a pair of elongate second cross members each having a locking bore formed on each end, each second cross member adapted to couple one pair of ends of said first cross members in orthogonal relation thereto; and a locking pin selectively inserted through a locking bore of said first cross member and said second cross member to secure each end of said first cross members and said second cross members.

17. The modular oven according to claim 16, further comprising another plurality of elongate vertical frame members each having a length different from said given length to change the height of said trolley.

18. A modular oven kit, comprising:

a plurality of interlockable insulated panels adapted to form a cubic housing defining a heating chamber when assembled, the plurality of panels including:

at least one elongate top panel;

at least one elongate bottom panel, the at least one bottom panel adapted to be spaced from the at least one top panel, the at least one bottom panel having:

an inner face and an outer face;

a heating element mounted on the inner face; and a power connector mounted on the outer face, the power connector being electrically connected to the heating element;

at least one elongate left side panel adapted to extend between the at least one top panel and the at least one bottom panel;

at least one elongate right side panel adapted to extend between the at least one top panel and the at least one bottom panel;

at least one elongate back panel adapted to extend between the at least one top panel, the at least one bottom panel, the at least one left side panel, and the at least one right side panel; and at least one elongate front panel adapted for pivotal mounting to one of the at least one side panels, the at least one front panel defining a door for the modular oven, the panels being interlockable to form the cubic heating chamber and separable without tools for compact storage and transport; and a control module adapted for detachable mounting to one of the panels, the control module controlling operation of the modular oven, the control module being electrically connected to the power connector on the at least one bottom panel.

19. The modular oven kit according to claim 18, further comprising a trolley system for transporting suspended workpieces into and out of said heating chamber.

20. A modular oven, comprising:

a detachable cubic housing formed from a plurality of insulated panels, the housing defining a heating chamber, each of the panels being detachably connected to at least another one of the panels to form the cubic heating chamber, the plurality of panels including:

an elongate top panel;

an elongate bottom panel spaced from the top panel, the bottom panel having:

an inner face and an outer face;

a heating element mounted on the inner face;

a power connector mounted on the outer face, the power connector being electrically connected to the heating element;

an elongate left side panel extending between the top panel and the bottom panel;

an elongate right side panel extending between the top panel and the bottom panel;

an elongate back panel extending between the top panel, the bottom panel, the left side panel, and the right side panel;

an elongate front panel pivotally mounted to one of the side panels, the front panel defining a door for the modular oven; and a control module detachably mounted to one of the panels, the control module controlling operation of the modular oven, the control module being electrically connected to the power connector on the bottom panel, wherein the control module comprises:

i) a substantially rectangular box having a front, back, top, bottom, and sides;

ii) a handle coupled to the top of the substantially rectangular box to ease portability and transport;

iii) a control panel at the front of the substantially rectangular box, the control panel having controls for setting and inputting at least temperature, duration of heating, and selective provision of power;

iv) a plurality of connectors disposed on the back of said substantially rectangular box; and v) a plurality of magnetic feet mounted to said bottom, the magnetic feet facilitating detachable mounting of the control module onto one of the panels.

* * * * *